US005328407A

United States Patent [19]

Sells

[11] Patent Number: 5,328,407

[45] Date of Patent: Jul. 12, 1994

[54] ROOF RIDGE VENT WITH TUBULAR BAFFLES

[76] Inventor: Gary L. Sells, 16250 Petro Dr., Mishawaka, Ind. 46544

[21] Appl. No.: 133,847

[22] Filed: Oct. 12, 1993

[51] Int. Cl.[5] ..... F24F 7/02

[52] U.S. Cl. ..... 454/365

[58] Field of Search ..... 52/57, 199; 454/365, 454/366, 367, 364

[56] References Cited

U.S. PATENT DOCUMENTS 4,676,147 6/1987 Mankowski ..... 454/365
4,817,506 4/1989 Cashman ..... 454/365
5,092,225 3/1992 Sells ..... 454/365
5,112,278 5/1992 Roberts ..... 454/365

*Primary Examiner*—Harold Joyce
*Attorney, Agent, or Firm*—James D. Hall

[57] ABSTRACT

A roof ridge vent which includes a cover plate supported by a plurality of elongated tubular baffles. Each tubular baffle has a plurality of holes for communicating air flow from the interior of the roof. The baffles are attached to the cover plate. The roof vent is secured to the roof sheathing by conventional fasteners extending through the cover plate. The tubular baffles space the cover plate above the sheathing to allow airflow from within the roof out a vent opening.

12 Claims, 2 Drawing Sheets

ROOF RIDGE VENT WITH TUBULAR BAFFLES

This invention relates to an improvement in roof ridge vents and will have application to a roof ridge vent with tubular baffles, which supports a cover plate.

SUMMARY OF THE INVENTION

The roof ridge vent described in U.S. Pat. No. 5,092,225, issued Mar. 3, 1992 to Sells, uses a baffle system which is incorporated into the cover plate to support and space the cover plate over the roof opening. The baffles are return bent undulating sheets of metal attached to the lower face of the cover plate. The baffles space the cover plate above the vent opening, and are perforated to allow the air flow communication through the baffles.

The roof vent of this invention uses a plurality of individual parallel tubular baffles to support and space the cover plate above the roof opening. The cover plate is fastened to the baffles with each baffle being perforated to allow air flow communication between the interior of the roof structure and the exterior.

Accordingly, it is an object of this invention to provide for an improved economical roof ridge vent.

Another object is to provide a roof ridge vent having a cover plate supported above the roof sheathing and roof opening by a plurality of tubular baffles.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

Figure 1:
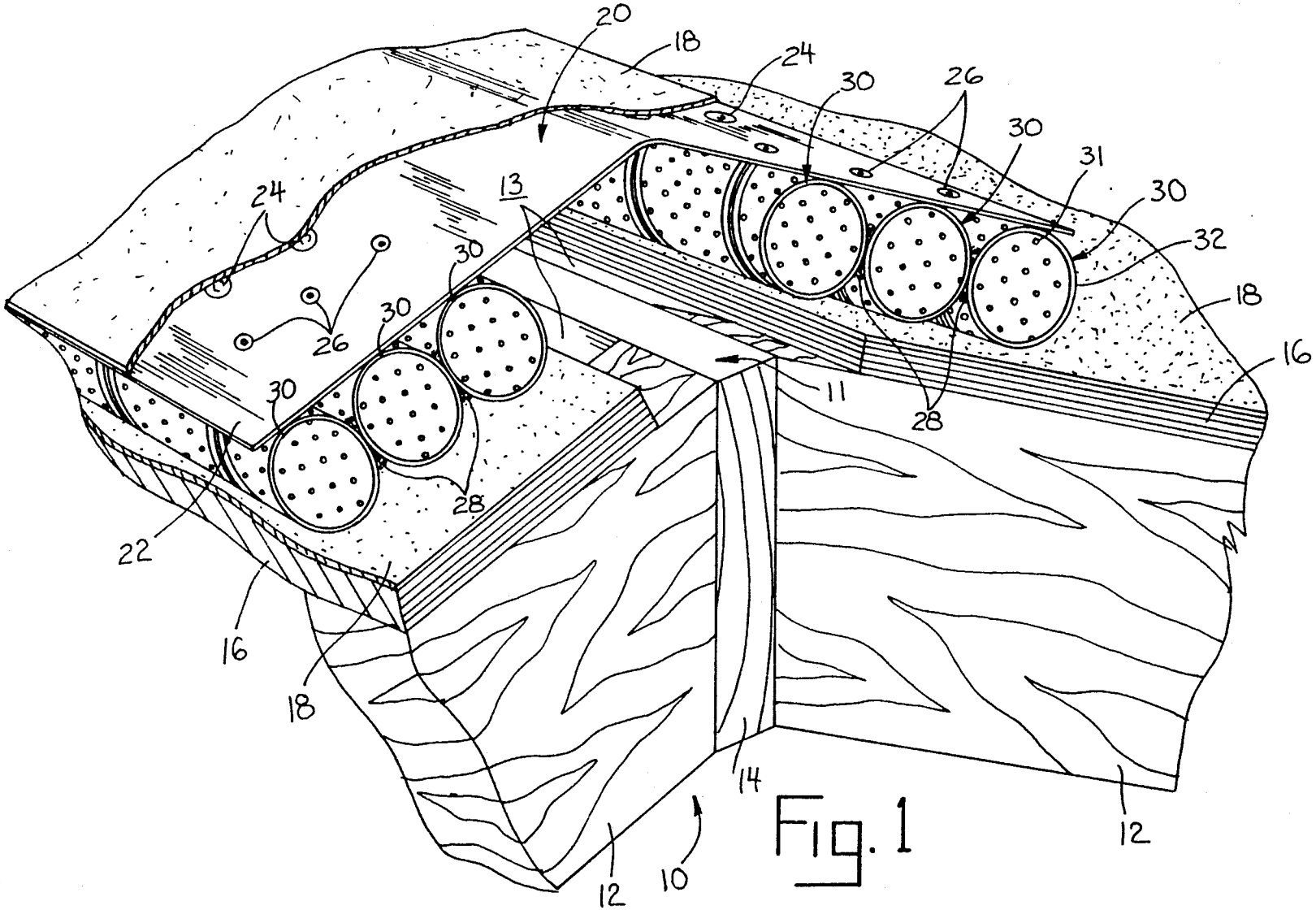
FIG. 1 is a fragmented perspective view of the roof ridge vent of this invention shown in use on a roof with portions of the roof and vent cut away for purposes of illustration.
Figure 2:
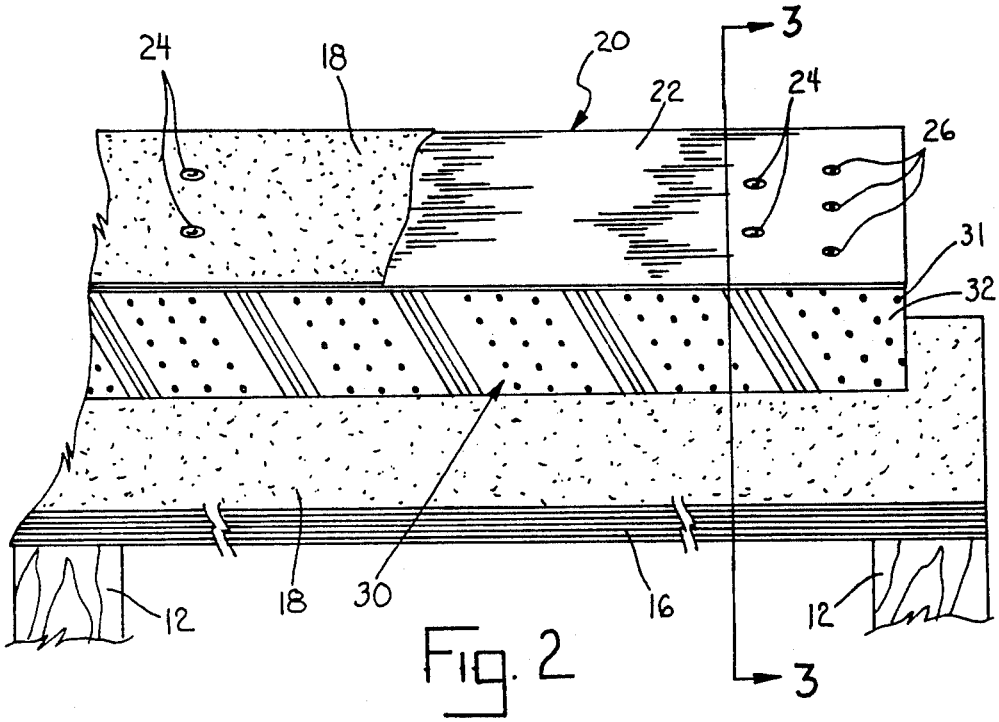
FIG. 2 is a fragmented side elevational view of the vent of FIG. 1.

The preferred embodiment herein described is not intended to be exhaustive or to limit the invention to the precise form disclosed. It is chosen and described to explain the principles of the invention and its application and practical use to enable others skilled in the art to utilize its teachings.

The figures show the roof ridge vent 20 of this invention used on a conventional two-sided slant roof 10. Roof 10 includes transversely spaced rafters 12 joined at its ridge 11 to a ridge beam 14. Roof sheathing 16 is secured to rafters 12 and is spaced at each side from ridge beam 14 to define vent openings 13. Sheathing 16 is covered by conventional roof covering materials, such as tiles or shingles 18 shown.

Roof ridge vent 20 includes a cover plate 22 and six elongated tubular baffles 30. As shown in the figures, three parallel baffles are positioned adjacent each other on either side of the ridge beam 14. Although six baffles are used in roof vent 13, any reasonable number of baffles can be used. Baffles 30 are constructed from any suitable material such as metal or plastic. Each baffle 30 has a side wall 32 with a plurality of holes or perforations 31 therein to allow air flow from the interior of a roof through vent openings 13. Adjacent baffles can be connected together at their side wall 32 by an adhesive in the case of plastic baffles or solder 28 in the case of metal rolled baffles.

Figure 3:
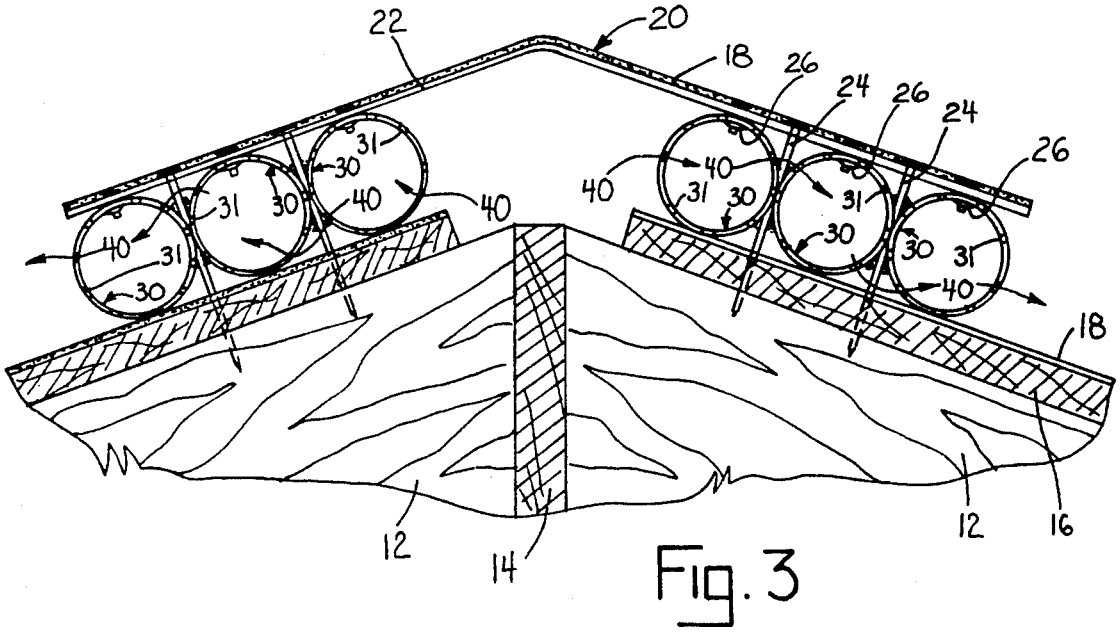
FIG. 3 is a cross sectional view taken along line 3—3 of FIG. 2.

Baffles 30 space cover plate 22 above sheathing 16 and vent openings 13. Cover plate 22 is secured to baffles 30 such as by rivets 26 as shown for the metal baffles or by an adhesive in the case of plastic baffles. Vent 20 is secured to sheathing 16 over vent openings 13 by conventional fasteners, such as roofing nails 24. Roofing nails 24 are driven into sheathing 16 through cover plate 22 and baffles 30. Shingles 18 are secured over cover plate 22 by fasteners 24. With roof vent 20 positioned on roof ridge 10 as shown in FIG. 3, free air flow from the interior of the roof is realized while the interior of the structure is shielded against ingress of moisture and elements.

It is understood that the above description does not limit the invention to the details given, but may be modified within the scope of the following claims.

I claim:

1. A vent for a roof, said vent constituting means for allowing air flow through a vent opening in said roof at its ridge, said vent comprising:

a cover plate overlying said vent opening, tubular baffle means paralleling said vent opening and positioned between said cover plate and said roof adjacent said vent opening for spacing said cover from said vent opening, and fasteners extending through said cover plate into said roof to secure said cover plate and said baffle means to said roof ridge.

2. The vent of claim 1 wherein said baffle means includes an elongated tubular section, said tubular section including a side wall having a plurality of holes formed therethrough, said holes constituting means for communicating air flow from said vent opening.

3. The vent of claim 2 wherein said baffle means includes a second said tubular section, said first mentioned and second tubular sections being parallel and located on opposite sides of said vent opening.

4. The vent of claim 2 wherein each said tubular section is connected to said cover plate.

5. The vent of claim 1 wherein said baffle means includes a plurality of parallel tubular sections, each of said tubular sections including a side wall with a plurality of holes formed therethrough, said holes constituting means for communicating air flow from said vent opening, at least two of said tubular sections being in an adjacent side-by-side orientation.

6. The vent of claim 5 wherein said tubular sections are located on opposite sides of said vent opening.

7. A vent adapted for use with a roof having a vent opening at its ridge, said vent constituting means for allowing air flow through said vent opening, and comprising:

a cover plate, tubular baffle means connected to said cover plate for spacing said cover plate from said vent opening when said cover plate is positioned over said vent opening and said tubular baffle means is positioned parallel and adjacent to said vent opening against said roof.

8. The vent of claim 7 wherein said baffle means includes an elongated tubular section, said tubular section including a side wall having a plurality of holes formed therethrough, said holes constituting means for communicating air flow from said vent opening.

9. The vent of claim 8 wherein said baffle means includes a second said tubular section, said first mentioned and second tubular sections being parallel and located on opposite sides of said vent opening when said vent is secured to said roof.

10. The vent of claim 8 wherein each said tubular section is connected to said cover plate.

11. The vent of claim 7 wherein said baffle means includes a plurality of parallel tubular sections, each of said tubular sections including a side wall with a plurality of holes formed therethrough, said holes constituting means for communicating air flow from said vent opening, at least two of said tubular sections being in an adjacent side-by-side orientation.

12. The vent of claim 11 wherein said tubular sections are located on opposite sides of said vent opening when said vent is secured to said roof.

* * * * *